US009382717B2

(12) United States Patent
Randjelovic

(10) Patent No.: US 9,382,717 B2
(45) Date of Patent: Jul. 5, 2016

(54) FLOORING SURFACE INTEGRATED WITH INTERLOCKING PLASTIC BASE

(71) Applicant: Connor Sports Flooring, LLC, Salt Lake City, UT (US)

(72) Inventor: Erlin Randjelovic, Crystal Falls, MI (US)

(73) Assignee: Connor Sports Flooring, LLC, Salt Lake City, UT (US)

( * ) Notice: Subject to any disclaimer, the term of this patent is extended or adjusted under 35 U.S.C. 154(b) by 0 days.

(21) Appl. No.: 14/486,784

(22) Filed: Sep. 15, 2014

(65) Prior Publication Data

US 2015/0128520 A1 May 14, 2015

Related U.S. Application Data

(60) Provisional application No. 61/878,459, filed on Sep. 16, 2013.

(51) Int. Cl.

| | |
|---|---|
| ***E04F 13/26*** | (2006.01) |
| ***E04F 15/02*** | (2006.01) |
| ***E04F 15/10*** | (2006.01) |
| ***E04F 15/04*** | (2006.01) |

(52) U.S. Cl.

CPC ..... *E04F 15/02038* (2013.01); *E04F 15/043* (2013.01); *E04F 15/10* (2013.01); *E04F 2201/0107* (2013.01); *E04F 2201/021* (2013.01)

(58) Field of Classification Search

CPC ..... E04F 13/0866

USPC ..... 52/177, 403.1, 745.19, 746.1, 591.1, 52/98; 156/39, 510; 428/292.4, 58, 60

See application file for complete search history.

(56) References Cited

U.S. PATENT DOCUMENTS

| | | | | |
|---|---|---|---|---|
| 4,057,948 | A | 11/1977 | Wise | |
| 5,365,710 | A | 11/1994 | Randjelovic | |
| 5,787,654 | A * | 8/1998 | Drost | 52/177 |
| 5,985,398 | A * | 11/1999 | Bellegarde | 428/54 |

(Continued)

FOREIGN PATENT DOCUMENTS

WO WO 03/040491 A1 5/2003

OTHER PUBLICATIONS

PCT Application No. PCT/US2014/055669; Filing date Sep. 15, 2014; Connor Sports Flooring, LLC.; International Search Report mailed Jan. 14, 2015.

*Primary Examiner* — Beth Stephan

(74) *Attorney, Agent, or Firm* — Thorpe North & Western, LLP

(57) ABSTRACT

A composite flooring structure and method of constructing a composite flooring structure are disclosed. An elongate plastic base having a top surface and a plurality of side walls forming a perimeter about the top surface is provided. An elongate contact surface material is secured to the elongate plastic base atop the plastic base, wherein the length and width of the elongate contact surface material exceeds the length and width of the elongate plastic base. After securing the elongate contact surface material to the elongate plastic base, the elongate contact surface material is cut such that the length and width of the elongate contact surface material approximates the length and width of the elongate plastic base. The elongate plastic base has a plurality of wings disposed about the sides of plastic base. The alignment wings are removed from the elongate plastic base after securing the elongate contact surface material to the elongate plastic base.

18 Claims, 9 Drawing Sheets

(56) References Cited

U.S. PATENT DOCUMENTS

| | | | | |
|---|---|---|---|---|
| 5,992,106 | A * | 11/1999 | Carling et al. | 52/177 |
| 6,189,283 | B1 | 2/2001 | Bentley et al. | |
| 6,415,562 | B1 * | 7/2002 | Donaghue et al. | 52/177 |
| 6,436,159 | B1 * | 8/2002 | Safta et al. | 51/298 |
| 6,596,362 | B1 * | 7/2003 | Chung | 428/55 |
| 7,634,876 | B2 * | 12/2009 | Moller, Jr. | 52/177 |
| 7,827,742 | B2 * | 11/2010 | Sansano Marti | 52/177 |
| 8,099,915 | B2 * | 1/2012 | Moller, Jr. et al. | 52/181 |
| 8,397,466 | B2 | 3/2013 | Jenkins et al. | |
| 2002/0100231 | A1 * | 8/2002 | Miller et al. | 52/177 |
| 2002/0152702 | A1 * | 10/2002 | Tseng | 52/403.1 |
| 2002/0189176 | A1 * | 12/2002 | Stegner et al. | 52/177 |
| 2003/0089051 | A1 | 5/2003 | Bertolini | |
| 2003/0136070 | A1 | 7/2003 | Ku | |
| 2004/0258869 | A1 * | 12/2004 | Walker | 428/44 |
| 2005/0284067 | A1 | 12/2005 | Mei | |
| 2006/0172118 | A1 * | 8/2006 | Han et al. | 428/156 |
| 2007/0044412 | A1 * | 3/2007 | Forster et al. | 52/592.1 |
| 2008/0034701 | A1 | 2/2008 | Pervan | |
| 2008/0086977 | A1 * | 4/2008 | Magnusson | 52/745.05 |
| 2009/0042010 | A1 * | 2/2009 | Stanhope | 428/292.4 |
| 2010/0068451 | A1 * | 3/2010 | Graf et al. | 428/99 |
| 2010/0212258 | A1 * | 8/2010 | Wysock et al. | 52/784.1 |
| 2011/0000167 | A1 * | 1/2011 | Dimke | 52/784.1 |
| 2012/0042602 | A1 * | 2/2012 | Buckwalter et al. | 52/741.1 |

* cited by examiner

FLOORING SURFACE INTEGRATED WITH INTERLOCKING PLASTIC BASE

PRIORITY CLAIM

This application claims priority to U.S. Provisional Application No. 61/878,459 filed on Sep. 16, 2013 entitled "Flooring Surface Integrated With Interlocking Plastic Base" which is incorporated herein by this reference in its entirety.

FIELD OF THE TECHNOLOGY

The present technology relates to flooring surfaces. Particularly, the technology relates to interlocking wood and plastic flooring composites and methods of manufacturing the same.

BACKGROUND OF THE TECHNOLOGY

Solid wood flooring is used in various applications including home, commercial, and sport flooring surfaces. Solid wood floors are desirable for aesthetic as well as functional reasons. In an athletic flooring application, solid wood floors provide a playing surface with desirable ball bounce characteristics while requiring relatively less maintenance than other flooring surfaces over the life of the flooring product. Conventional solid wood flooring surfaces used in athletic flooring applications utilize continuous solid wood slats or planks placed on sub-floor systems. U.S. Pat. No. 5,369,710 to Randjelovic et al., for example, demonstrates widely used floating sports flooring system construction. The designs disclosed in this patent include resilient components resting on a supporting substrate which in turn supports a wooden sub-floor and flooring surface. A sub-floor is used to provide ventilation and minimize problems associated with expansion and contraction of the overlying hardwood surface. Conventional hardwood flooring systems thus require the use of a significant amount of wood resources and a significant amount of human resources to install. It is therefore desirable to have an improved hard wood flooring system that provides the same or similar characteristics as a conventional hard wood flooring system but without the attendant problems associated with the same.

BRIEF DESCRIPTION OF THE DRAWINGS

The present technology will become more fully apparent from the following description and appended claims, taken in conjunction with the accompanying drawings. Understanding that these drawings merely depict exemplary aspects of the present technology they are, therefore, not to be considered limiting of its scope. It will be readily appreciated that the components of the present technology, as generally described and illustrated in the figures herein, could be arranged and designed in a wide variety of different configurations. Nonetheless, the technology will be described and explained with additional specificity and detail through the use of the accompanying drawings in which:

DETAILED DESCRIPTION OF EXEMPLARY ASPECTS OF TECHNOLOGY

Figure 1:
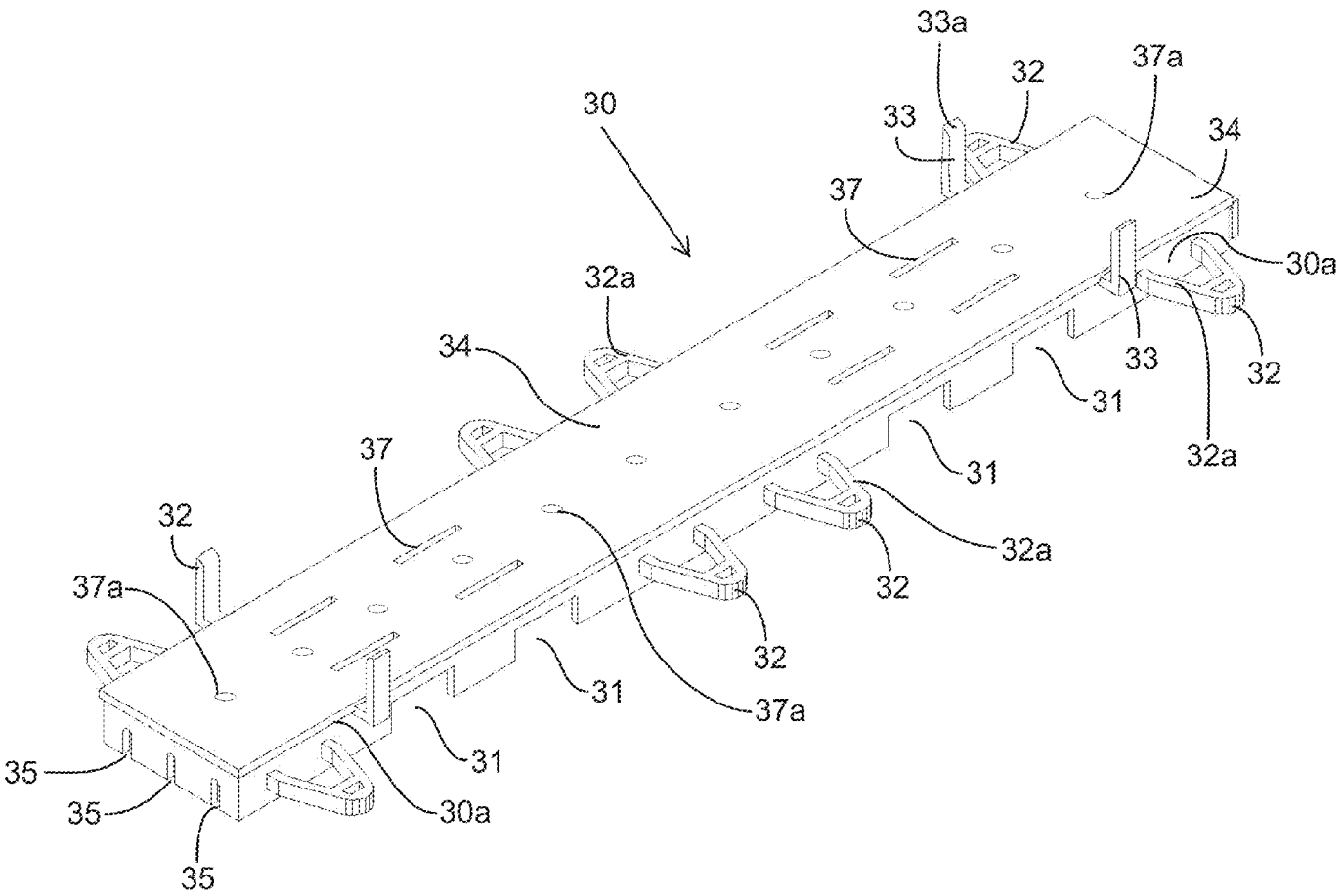
FIG. 1 is a perspective view of an elongate base panel in accordance with one aspect of the technology.

The following detailed description of exemplary aspects of the technology makes reference to the accompanying drawings, which form a part hereof and in which are shown, by way of illustration, exemplary aspects in which the technology may be practiced. While these exemplary aspects are described in sufficient detail to enable those skilled in the art to practice the technology, it should be understood that other aspects may be realized and that various changes to the technology may be made without departing from the spirit and scope of the present technology. Thus, the following more detailed description of the aspects of the present technology is not intended to limit the scope of the technology, as claimed, but is presented for purposes of illustration only and to describe the features and characteristics of the present technology, to set forth the mode of operation of the technology, and to sufficiently enable one skilled in the art to practice the invention. Accordingly, the scope of the present invention is to be defined solely by the appended claims.

The following detailed description and exemplary aspects of the technology will be understood by reference to the accompanying drawings, wherein the elements and features of the technology are designated by numerals throughout.

In accordance with one aspect of the technology, the present technology resides in a plurality of interconnecting elongate molded plastic base components disposed on a ground surface. The plastic components comprise a plurality of mating locking hooks and slots for receiving said hooks. Prior to disposing the base components onto the ground surface in an assembly, an elongate contact surface material, such as hard wood, is secured on top of the base component. The end result is an improved composite flooring section that may be interlocked with an adjacent flooring section. As will be appreciated, since the subject base component incorporates the use of synthetic materials, which may include recycled plastic materials, it has, among others, the advantage of being environmentally friendly, e.g., it reduces the use of forestry materials. The decrease in use of forestry materials also results in decreased weight of the end product which reduces shipping costs and increases the ease of installation. In addition, it will be understood that the base component has the advantage of providing design flexibility, e.g., the formed base components can be provided with a wide range of cavity designs that, in turn, allow for strategic placement of contact flooring components.

While specific reference is made herein with respect to flooring products, it is understood that the processes and technology described herein could be implemented in other technology fields such as wall or ceiling paneling and any claims directed towards such a use are contemplated herein.

The process for manufacturing solid wood flooring requires precision cutting as the dimensioning and tolerances for abutting wood slats on an athletic flooring surface are very rigid. For example, the National Wood Flooring Association recommends machining tolerances for conventional wood floors in the thousandths of inches. Aspects of the present technology provide systems and methods for preparing a composite wood/plastic flooring component that can include a rough-cut wood plank that is later cut to a precise length and width matching precisely the underlying plastic base component. Generally speaking, a rough-cut wood plank is placed face down on a work surface. An industrial adhesive is placed on the back side of the wood plank and the plastic base component is pressed face down on the back side of the wood plank. The rough-cut wood plank is sized larger than the outer dimensions of the plastic base component to accommodate precision cutting at a later time. Once the assembly is complete and the assembly is cut, the composite flooring component is capable of mating with other composite flooring components to form a flooring surface that mimics a conventional wood flooring assembly without the attendant drawbacks of such an assembly. Specifically, the hardwood sections will abut closely with one another side-to-side and end-to-end in a manner similar to a conventional tongue and groove assembly.

Turning now to the figures, FIG. 1, is a perspective detail showing one aspect of the technology, discloses an elongate synthetic base panel section 30 having side wall slots 31 and locking hooks 32. Side wall slots 31 in a first base panel section will mate with locking hooks 32 in a second adjacent base panel section. The base panel section 30 is made of any suitable synthetic material, including, but without limitation, thermoplastics and thermosetting polymers. For example, in accordance with one aspect of the technology, base panels 30 are preferably manufactured in typical plastic molding operations, with the most preferred material being a type of commonly molded plastic. Polypropylene, polyethylene, and PVC represent a few examples of numerous types of plastics that can be used. The base panel 30 may be formed using conventional molding techniques, such as injection molding, or other molding processes known to one of ordinary skill in the art. In one aspect of the technology, the base panel section 30 will have a height ranging between 0.5 and 1.0 inches with a preferred height of 0.75 inches; a width ranging between 1.75 and 3.0 inches with a preferred width of 2.25 inches; and a length of 12.0 to 18.0 inches with a preferred length of 16.0 inches. In one aspect of the technology, the contact surface material 42 will have a thickness ranging from between 0.10 to 0.50 inches with a preferred thickness of 0.25 inches. Of course, other dimensions may be used as suits a particular application without departing from the spirit of the technology described herein.

The term "contact surface material" as used herein refers generally to any material disposed on the base panel section 30 and is used as the final contact or playing surface for the finished floor. In one aspect of the technology, the contact surface material 42 comprises a solid hard wood material such as maple or beech wood. However, other contact surface materials are contemplated for use herein including synthetic materials such as a laminate or other polymer materials or wood-based materials. Use of the term "natural wood material" or "wood-based material" within this document includes wood products such as solid hard wood referenced above, plywood, HDF, MDF, LDF, and other wood products known to one of ordinary skill in the art. Material such as rubber, cork, vinyl and other materials suitable for floor applications can also be secured to plastic base panels 30 as the contact surface material 42. Moreover, while specific reference is made herein to a single surface contact material 42 being secured to a plastic base panel 30 forming a two-layer composite material, more than one layer of material may be secured to the plastic base panel 30 as suits a particular application. For example, a resilient layer may be disposed between the surface contact material 42 and the plastic base panel 30 forming a three-layer composite structure.

Removable alignment wings 33 protrude upward in strategic locations at a designated height above the base plate top surface 34. In one aspect of the technology, the alignment wings 33 are molded into the base plate section 30 and have a general L-shaped geometry with a tapered top section 33*a*. The alignment wings 33 are located about the side 30*a* of plate section 30 and extend outward from the sides 3*a* approximately 0.25 inches and upward approximately 0.5 inches. A bottom 33*b* of alignment wing 33 is disposed at an elevation above the top 32*a* of locking hook 32. The alignment wings 33 serve numerous purposes. First, the alignment wings 33 serve as an alignment guide when placing a flooring material 42 (e.g. a rough-cut wood plank) atop the base plate top surface 34. In this manner, the rough-cut wood plank may be placed on the top of the base plate 30 in such a way as to optimize its placement for proper securement and later cutting. In one aspect, the rough-cut plank exceeds the lateral and longitudinal dimensions of the base plate 30 slightly (e.g., 0.1 inches) so that the entire assembly may be precision cut at a later time. Second, the alignment wings 33 also serve as trimming guides. That is, after a contact surface material 42 is secured to the top surface 34 of the base plate 30, the entire assembly is turned upside down and placed face-down on an assembly line for trimming the sides of the flooring material to match the width of the base panel 30. The alignment wings 33 are disposed within a journaled track that is oriented parallel with the assembly line. As such, the alignment wings 33 maintain the alignment of the composite flooring member with respect to the trimming tool (e.g., a saw) as it travels down the assembly line. In one aspect of the technology, the alignment wings 33 are cut from the base panel 30 as it travels down the assembly line to produce a final product with precision cut edges.

While specific reference is made herein to an L-shaped alignment wing, other shapes are contemplated for use herein. For example, an arcuate arrangement may be used to accommodate different types of flooring materials or different rough cuts. Moreover, other means for providing a trimming guide are contemplated herein. For example, in one aspect of the technology, the trimming guide may be a clip or other device affixed to the contact surface material itself which is also removed from the flooring material as it travels down the assembly line. Other arrangements for precision cutting of the composite base plate 30/contact surface material 42 are contemplated herein. For example, a rough-cut contact surface material 42 may be secured to a top surface 34 of the base plate 30 and placed on a track with appropriate guide rails built into the track that provide appropriate dimensioning based on the width of the base plate 30 without use of any trimming guides associated with the composite product itself.

Surface slots 37 are disposed in the top plate surface 34 and, in some aspects, are present as a result of the molding process. In another aspect of the technology, weep holes 37*a* are disposed about the top surface 34. The weep holes 37*a* provide a means for flowable adhesive placed on a back side of a contact surface material 42 to pass through the top surface 34 of the base panel 30 and pool on the bottom side of the base panel 30. In one aspect of the technology the weep holes 37*a* are placed longitudinally down the center of the base plate 30. In other aspects, however, the weep holes 37*a* are placed in a grid about the entire top surface 34 of base plate 30. In one aspect, the weep holes 37*a* are beveled or tapered on the top surface 34 of the base panel 30 or on the back surface as suits a particular application to increase the total surface area in contact with the adhesive. The holes may be circular, rectangular, or any other shape as suits a particular application and has an opening area ranging from 0.05 to 1.0 inches. In a preferred aspect, the area of the opening of any individual weep hole 37*a* will not exceed 0.25 inches.

In one aspect of the technology, the adhesive is a commercial grade pressure sensitive adhesive or contact adhesive including, but without limitation, urethanes, polymer-based adhesives, and the like. While reference is made herein to a process whereby the contact surface material 42 is secured to the base panel 30 by way of an adhesive, it is understood that other means of securing the contact surface material 42 to the base plate 30 are contemplated herein. By way of example only, the contact surface material 42 may also be secured by using a bolt and nut assembly, threaded screws, rivets, or other securing means.

Figure 2:
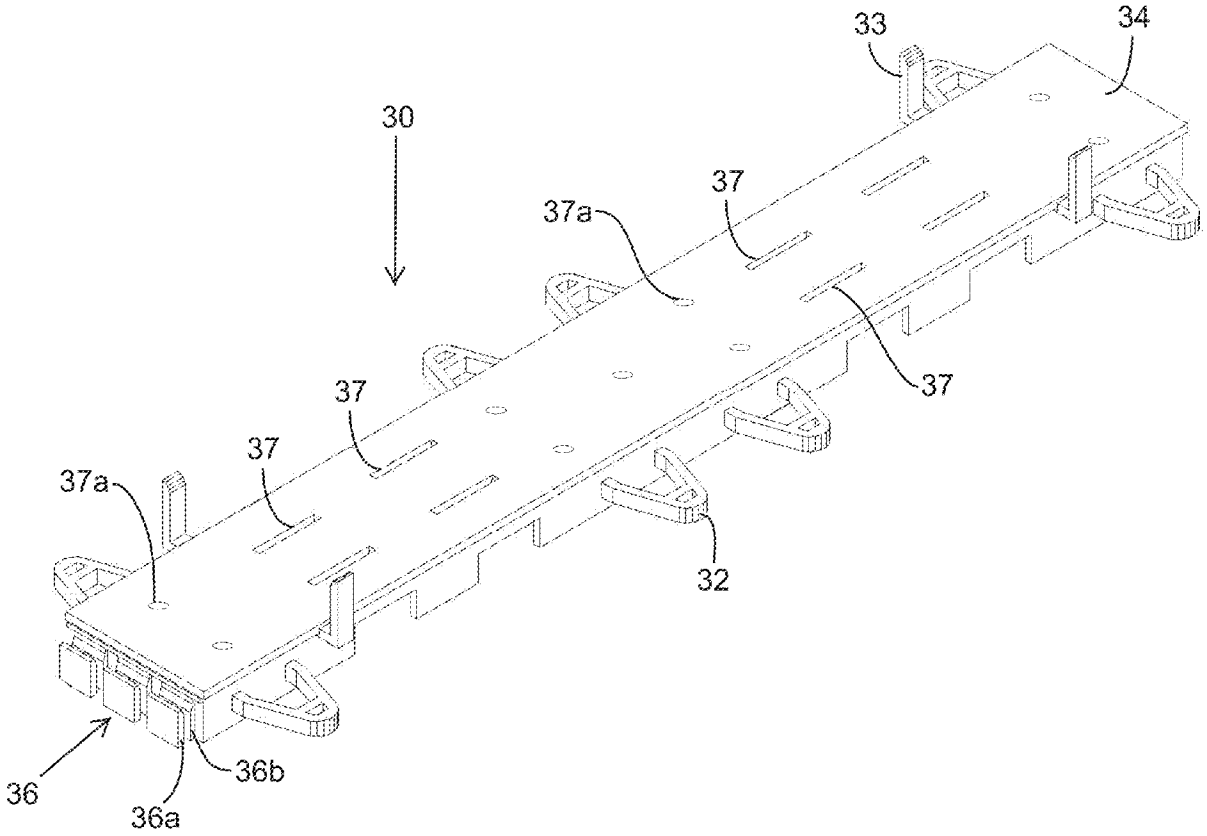
FIG. 2 is a perspective view of an elongate base panel in accordance with one aspect of the technology.

With additional reference to FIG. 2, is a perspective detail showing a base panel section 30 in an opposing direction to the detail as shown in FIG. 1 showing a different arrangement of weep holes 37*a*. End locking slots 35 are included at one end of each base panel section 30 as shown in FIG. 1 and are intended to mate with end locking tabs 36 that are disposed at an opposite end of each base panel section 30. The end locking tabs 36 comprise three rectangular-shaped protrusions 36*a* separated from three adjacent rectangular-shaped protrusions 36*b* by a narrow member 52. The protrusions 36*a*, 36*b* are disposed substantially parallel with the end of the base panel 30. The narrow member 52 is disposed substantially perpendicular to the end of the base panel 30 and the rectangular-shaped protrusions 36*a*, 36*b*. When mating two adjacent ends of base panels 30 together, an end 50 of the first base panel 30 is disposed between the end locking tabs 36 and the end 51 of the second base panel 30. The end locking tabs 36 are disposed behind the end 50 of the first base panel 30. The narrow member 52 connecting the end locking tabs 36 with end 51 of the second base panel 30 is disposed within the end locking slots 35. The rectangular-shaped protrusions 36*a*, 36*b* are beveled near a top of the protrusion to enable placement of the end 50 of the first base panel 30 between opposing rectangular-shaped protrusions 36*a*, 36*b*. While the protrusions herein are shown as having a generally rectangular shape, it is understood that any desirable shape could be used in connection herewith.

Figure 3:
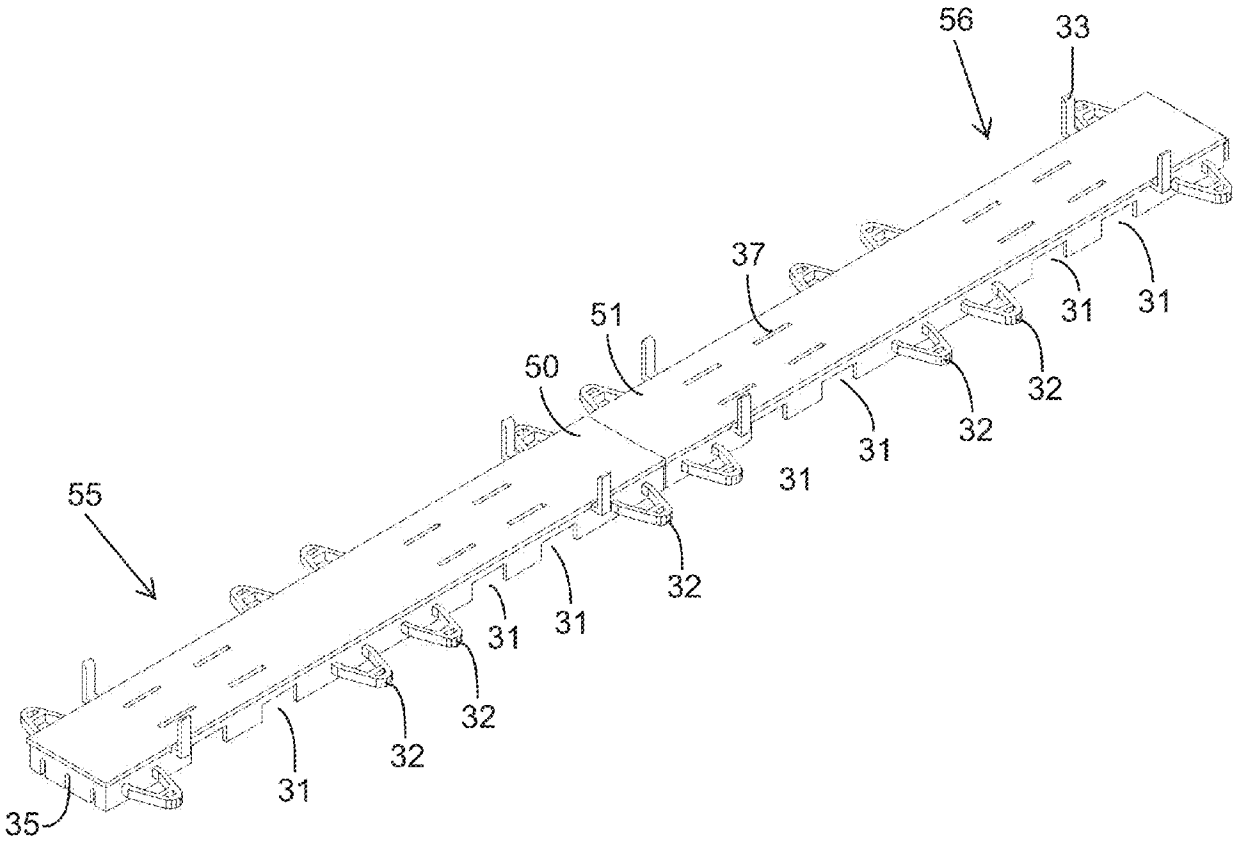
FIG. 3 is a perspective view of two elongate base panels mated together in accordance with one aspect of the technology.
Figure 4:
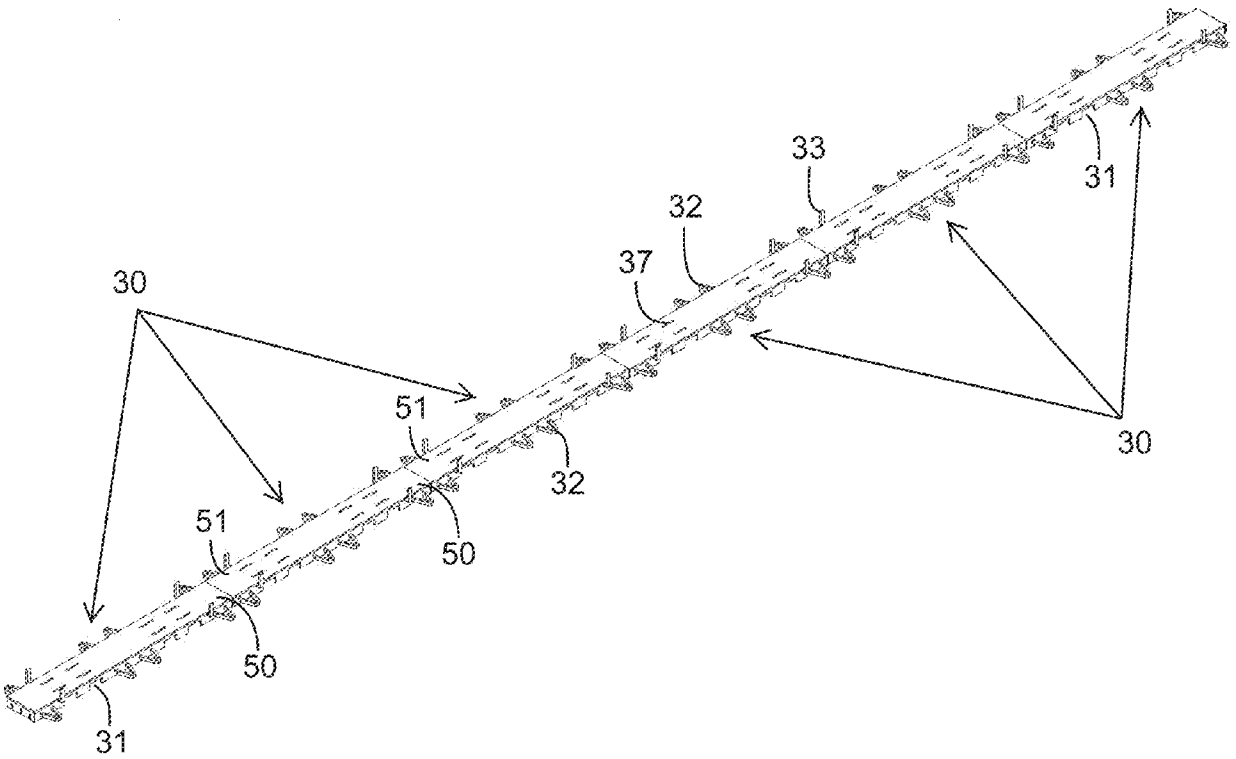
FIG. 4 is a perspective view of six elongate base panels mated together in accordance with one aspect of the technology.

FIG. 3 is a perspective detail showing connection of two base panel sections 30 attached end-to-end to create a continuous pattern of two wall slots 31 adjacent to two locking hooks 32. FIG. 4 is a perspective detail showing connection of numerous base panel sections 30 to form a desired length for attachment to preferred surface material length. For example, if it were desirable to have a flooring configuration with wood flooring panels that were six inches in width and eight feet in length, a plurality of six-inch wide base panels are placed end to end until the eight-foot length is reached. Once the panels are secured end-to-end, a wood-flooring material that is at least eight feet in length and at least six inches wide is secured to the connected base-panel section. In a preferred aspect, the wood-flooring material is slightly longer than eight feet and slightly wider than six inches so that it may be trimmed to precisely match the length and width of the connected base-panel section.

Figure 5:
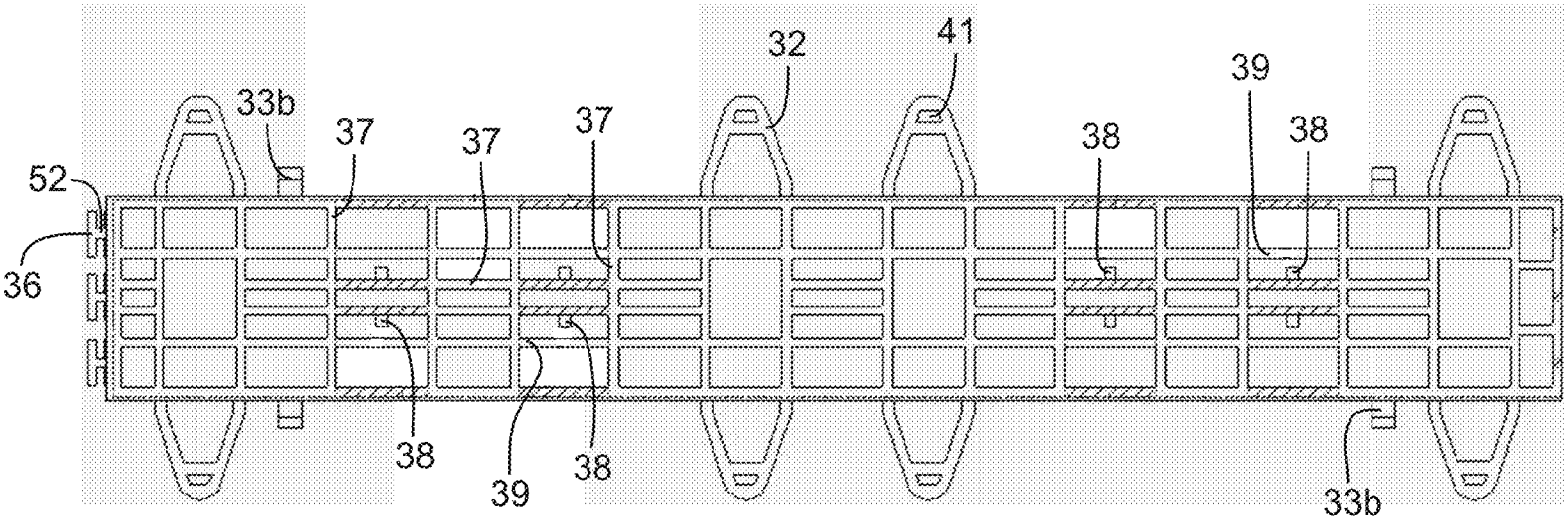
FIG. 5 is a top skeletal view of a base panel section without an upper plate surface in accordance with one aspect of the technology.
Figure 6:
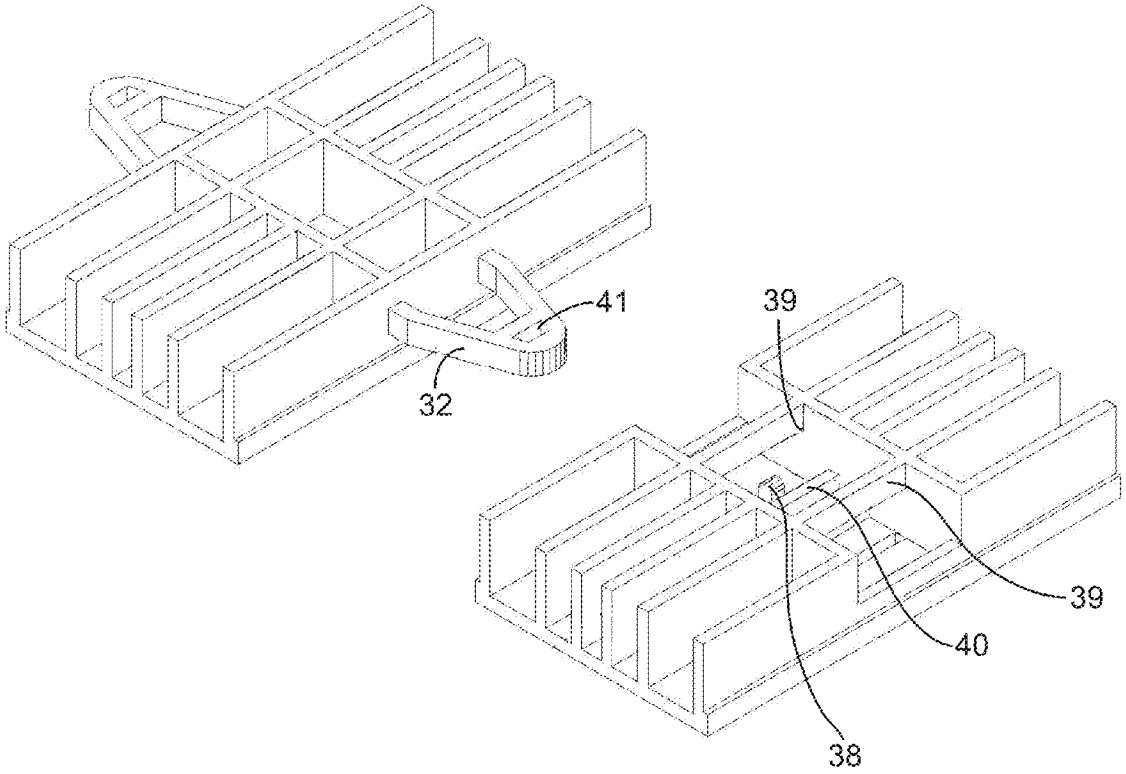
FIG. 6 is a perspective cut away view showing a locking mechanism in accordance with one aspect of the technology.
Figure 7:
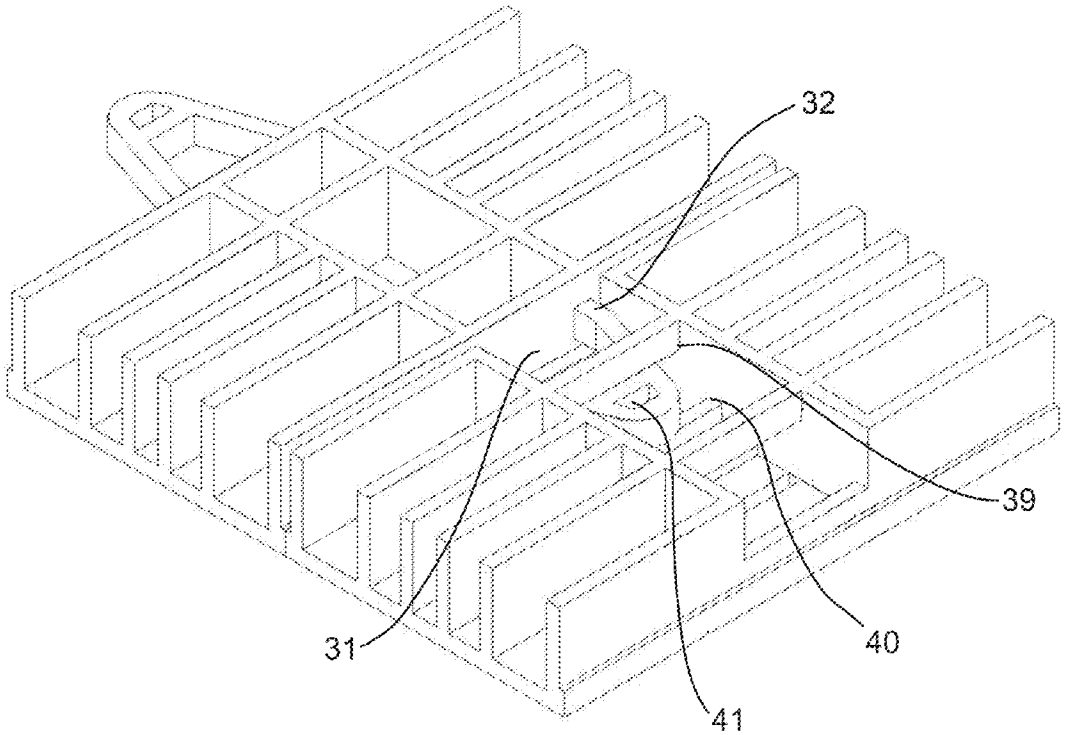
FIG. 7 is a perspective cut away view showing a locking mechanism in accordance with one aspect of the technology.

FIG. 5 is a top skeletal view of a base panel section 30 without the upper plate surface 34. Wall slots 31 and locking pins 38 are disclosed. Locking pins 38 engage with locking hooks 32 as described further below. With reference now to FIGS. 6 and 7, an underside perspective view of adjacent portions of base panel sections 30 is disclosed. FIG. 6 shows the adjacent sections in an unconnected state while FIG. 7 shows the adjacent sections connected. Specifically, a first base panel section 55 having two locking hooks 32 on opposite sides prior to penetration through a side wall slot 31 in a second base panel section 56 is shown. The second base panel 56 has a side wall slot 31 that passes from one side of the second base panel 56 to the adjacent side. The slot 31 comprises an upper wall 39 and a lower wall 40. Locking hook 32 is generally A-shaped extending outward from a side of the first base panel 55. The distal end of the locking hook 32 has an end pocket 41 for attachment to locking pin 38 once the hook 32 is inserted into slot 31. As the locking hook 32 is inserted into slot 31 it is inserted below the upper wall 39 and above the lower wall 40 until locking pin 38 engages with end pocket 41. In this manner, locking pin 38 engagement with the locking hook 32 minimizes lateral movement in and out of the slot 31, while the upper wall 39 and lower wall 40 engagement with the locking hook 32 minimizes any tendency of the first base panel 55 to pitch or roll with respect to the second base panel 56.

Figure 9:
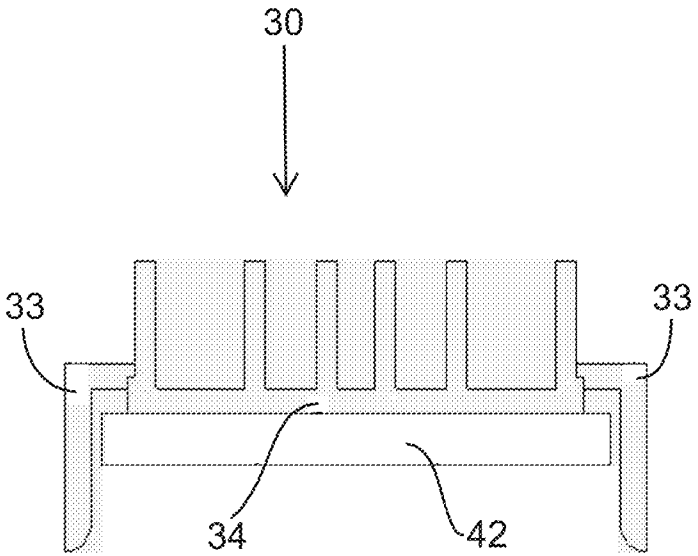
FIG. 9 is a side cut away view of a base panel and contact surface material in accordance with one aspect of the technology.
Figure 8:
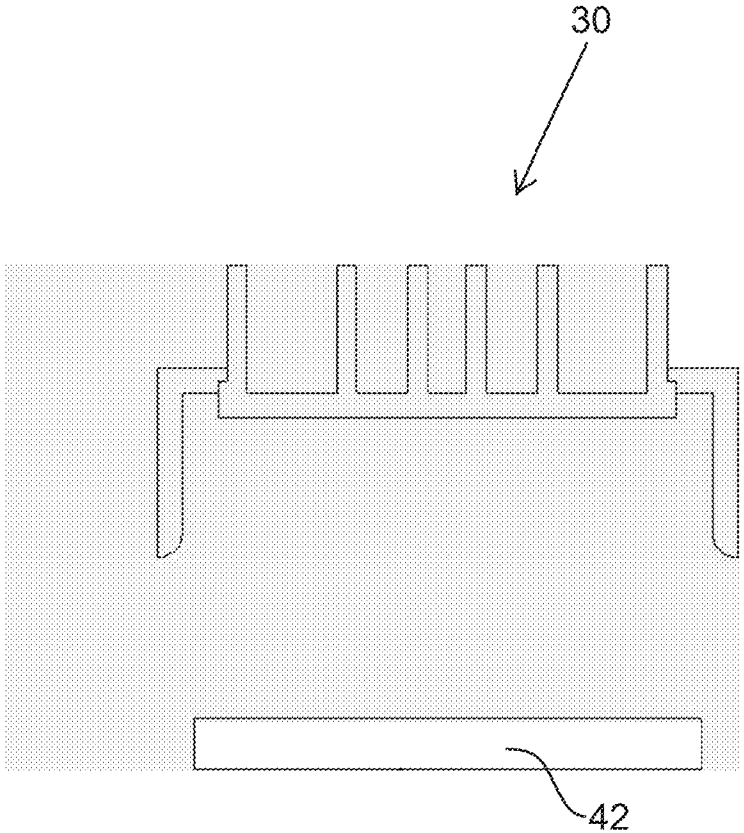
FIG. 8 is a side cut away view of a base panel and contact surface material in accordance with one aspect of the technology.

FIG. 8 is an end view of a base panel 30 in an upside down position showing positioning of contact surface section 42 which, in accordance with one aspect of the technology, is dimension wood material. FIG. 9 is an end view showing placement of base panel 30 onto surface section 42 after securing the contact surface section 42 to the base plate top surface 34. Following securement, alignment wings 33 are removed and contact surface section 42 is trimmed accordingly to match the width and length of base panel section 30. In accordance with one aspect, the surface section 42 has a finished upper surface prior to being secured to the base panel 30. In this manner, once the contact surface section 42 component of the composite contact surface section 42/base panel 30 is trimmed to the desired length and width, it is substantially ready to be packaged and shipped. In another aspect, however, the contact surface section 42 is substantially unfinished. That is, in the case of wood material, it has no sanding, painting, or finish coating prior to be secured to the base panel 30. Once secured, the contact surface section 42 is trimmed to an appropriate width and length and then finished and treated according to a desired specification.

Figure 10:
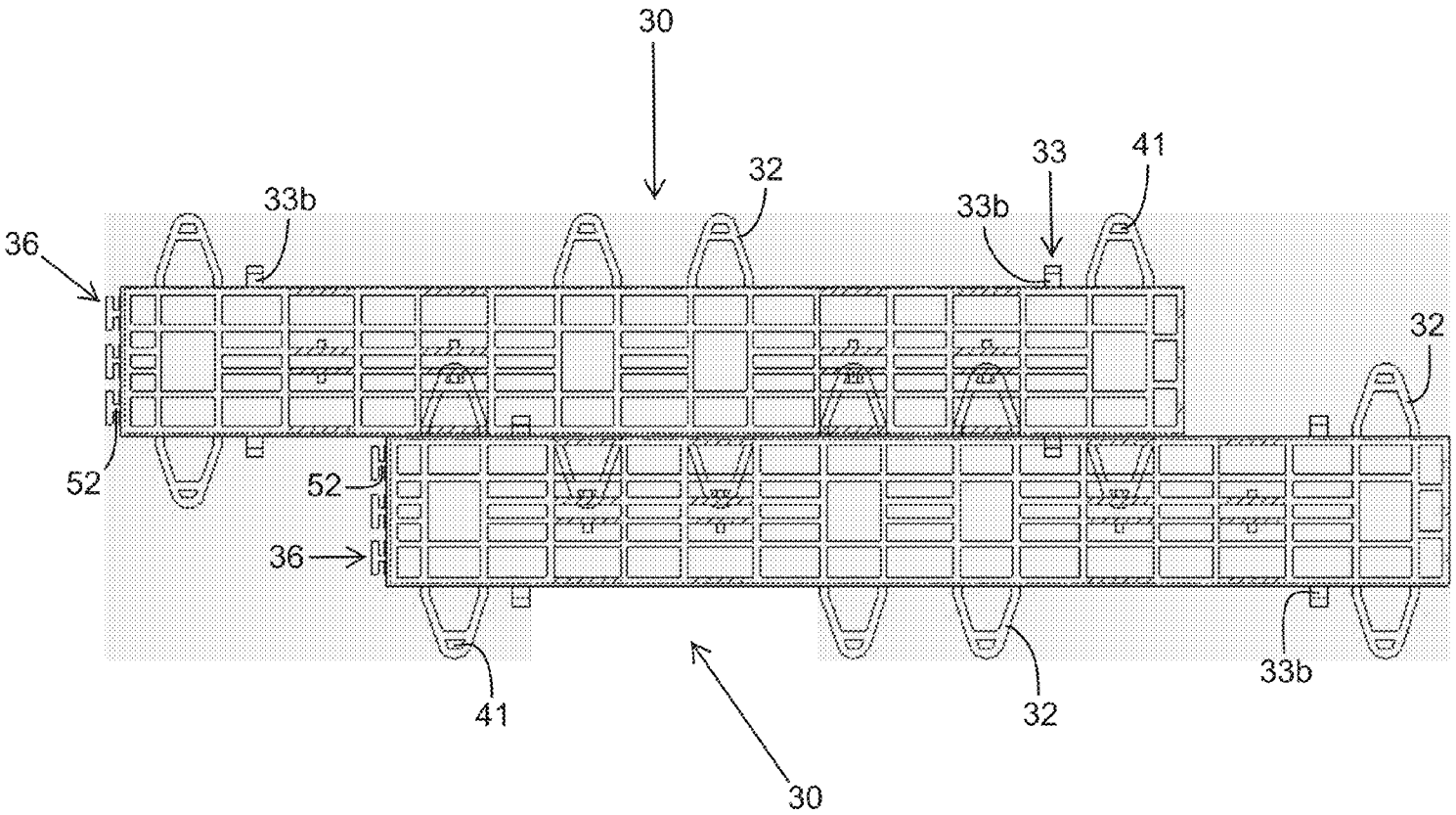
FIG. 10 is a skeletal top view of adjacent base panel sections without a base plate surface.

Referring now to FIG. 10, a skeletal top view (i.e., with no base plate surface) showing attachment of adjacent base panel sections 30 as described above is provided. Locking hooks 32 are disposed within slots 31 and between upper wall 39 and lower wall 40 with the end pocket 41 of the locking hooks 32 engaged with the locking pin 38. While specific reference is made to locking hooks and pins, it is understood that other connection arrangements may be used in connection herewith.

In accordance with one aspect of the technology, before the base panel sections 30 are connected together, the surface section 42 is secured to the base panel 30 and trimmed accordingly. As such, alignment wings 33 will not be present in an assembly where base panels 30 are connected side-to-side as alignment wings 33 are removed during the trimming process. The foregoing detailed description describes the technology with reference to specific exemplary aspects. However, it will be appreciated that various modifications and changes can be made without departing from the scope of the present technology as set forth in the appended claims. The detailed description and accompanying drawings are to be regarded as merely illustrative, rather than as restrictive, and all such modifications or changes, if any, are intended to fall within the scope of the present technology as described and set forth herein.

More specifically, while illustrative exemplary aspects of the technology have been described herein, the present technology is not limited to these aspects, but includes any and all aspects having modifications, omissions, combinations (e.g., of aspects across various aspects), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the technology should be determined solely by the appended claims and their legal equivalents, rather than by the descriptions and examples given above.

The invention claimed is:

1. A method of constructing a composite flooring structure, comprising:

providing an elongate plastic base having a top surface and a plurality of side walls forming a perimeter about the top surface;

securing an elongate contact surface material to the elongate plastic base atop the plastic base, wherein a length and width of the elongate contact surface material exceeds a length and width of the elongate plastic base;

after securing the elongate contact surface material to the elongate plastic base, cutting the elongate contact surface material such that the length and width of the elongate contact surface material approximates the length and width of the elongate plastic base; and wherein the elongate plastic base comprises a plurality of alignment wings disposed about sides of the plastic base, the method further comprising the step of removing the alignment wings from the elongate plastic base after securing the elongate contact surface material to the elongate plastic base.

2. The method of claim 1, wherein the alignment wings comprise an L-shaped bracket formed from and integrated with the elongate plastic base.

3. The method of claim 1, wherein the elongate plastic base further comprises a locking tab and a locking pin.

4. The method of claim 3, wherein a bottom surface of the alignment wings is disposed at an elevation above a top surface of the locking tabs.

5. The method of claim 3, wherein the alignment wings are disposed on opposing sides of the elongate plastic base.

6. The method of claim 1, wherein the elongate plastic base further comprises a plurality of apertures disposed on the top surface and a plurality of apertures disposed in the side walls.

7. The method of claim 1, further comprising the step of treating the elongate contact surface material with a sealant.

8. The method of claim 1, wherein the elongate contact surface material comprises a natural wood material adhered to the elongate plastic base.

9. A composite flooring structure, comprising:

an elongate synthetic base having a top surface and a plurality of side walls forming a perimeter about the top surface;

a locking hook extending outward from a side wall of the elongate base;

a plurality of opposing alignment wings disposed about side walls of the elongate base; and an elongate contact surface material secured to the top surface of the synthetic base, wherein the elongate contact surface material has a width and length that exceeds a length and width of the elongate synthetic base and wherein a bottom of the opposing alignment wings is disposed at an elevation above a top of the locking hook.

10. The composite flooring structure of claim 9, further comprising a locking pin disposed beneath the top surface.

11. The composite flooring structure of claim 9, further comprising a support system extending downward from the top surface.

12. The composite flooring structure of claim 9, wherein the elongate contact surface comprises a wood product.

13. The composite flooring structure of claim 9, wherein the opposing alignment wings comprise an L-shaped member formed with the synthetic base extending laterally outward from the side walls and upward above the top surface of the elongate synthetic base.

14. The composite flooring structure of claim 9, further comprising apertures disposed within the top surface of the elongate synthetic base, wherein the apertures comprise a tapered edge surface.

15. A composite flooring assembly, comprising:

at least two rectangular elongate synthetic bases coupled adjacent and abutted against one another, each elongate synthetic base having:

a top surface and a plurality of side walls forming a perimeter about the top surface;

a locking pin extending downward from the top surface;

a locking hook extending outward from a side wall configured to mate with a locking pin of an adjacent elongate synthetic base;

a plurality of holes disposed within the top surface of the synthetic base;

a rectangular elongate contact surface material secured to the top surface of the synthetic base;

wherein when adjacent elongate synthetic bases are coupled adjacent and abutted against one another, adjacent rectangular contact surface materials are also abutted against one another.

16. The composite assembly of claim 15, wherein the rectangular elongate contact surface comprises a wood material cut to approximate the perimeter of the top surface of the synthetic base after the wood material has been secured to the top surface of the synthetic base.

17. The composite assembly of claim 16, wherein the rectangular elongate contact surface is adhered to a top of the synthetic base and wherein an adhesive is applied to a back side of the elongate contact surface and pressed through the plurality of holes disposed on the top surface of the synthetic base.

18. The composite assembly of claim 16, further comprising a slot formed in a side wall of the synthetic base, the slot comprising an upper wall and a lower wall, wherein the locking hook from an adjacent base is configured to be inserted into the slot below the upper wall and above the lower wall and engage the locking pin.

* * * * *